US005379017A

United States Patent [19]

Katsuno

[11] Patent Number: 5,379,017

[45] Date of Patent: Jan. 3, 1995

[54] SQUARE CHIP RESISTOR

[75] Inventor: Takafumi Katsuno, Kyoto, Japan

[73] Assignee: Rohm Co., Ltd., Kyoto, Japan

[21] Appl. No.: 142,225

[22] Filed: Oct. 25, 1993

[51] Int. Cl.[6] ..... H01C 1/148

[52] U.S. Cl. ..... 338/332; 338/313; 338/333; 338/272

[58] Field of Search ..... 338/332, 328, 306, 313, 338/272, 307, 308

[56] References Cited

U.S. PATENT DOCUMENTS

| | | | |
|---|---|---|---|
| 4,684,916 | 8/1987 | Ozawa | 338/308 |
| 4,780,702 | 10/1988 | Snel et al. | 338/308 |
| 4,792,781 | 12/1988 | Takahashi et al. | 338/307 |
| 4,829,553 | 5/1989 | Shindo et al. | 338/309 |
| 4,992,771 | 2/1991 | Caporali et al. | 338/22 R |
| 5,170,146 | 12/1992 | Gardner et al. | 338/313 |
| 5,287,083 | 2/1994 | Person et al. | 338/332 |

FOREIGN PATENT DOCUMENTS

| | | |
|---|---|---|
| 3-212901 | 9/1991 | Japan . |
| 4-355901 | 12/1992 | Japan . |

*Primary Examiner*—Marvin M. Lateef

*Attorney, Agent, or Firm*—Brumbaugh, Graves, Donohue & Raymond

[57] ABSTRACT

A square chip resistor in which, when the protective glass layers are fired, a powder of an inorganic material such as alumina or the like having a greater thermal expansion coefficient than glass is mixed into glass paste to thereby adjust the thermal expansion coefficient of the protective glass layers. This makes it possible to prevent generation of any crack on the glass surface due to a stress produced by a difference between the thermal expansion coefficients of the glass layer and an alumina substrate.

3 Claims, 2 Drawing Sheets

SQUARE CHIP RESISTOR

BACKGROUND OF THE INVENTION

The present invention relates to a square chip resistor which includes an insulation substrate and a resistor provided on the insulation substrate and, in particular, to a square chip resistor which prevents generation of any crack on a protective glass surface due to internal stresses to be produced by change in temperatures.

In recent years, in order to enhance the wiring density of a circuit substrate, there has been often used a very small square chip resistor as a resistance element. To produce the square chip resistor, a resistor layer and an electrode layer are formed on an insulation substrate and a protective glass layer is formed in such a manner that it covers the resistor and electrode layers.

In FIG. 1, there is shown a conventional square chip resistor which is disclosed in Unexamined Japanese Patent Publication (Kokai) Hei-3-212901. In FIG. 1, the conventional square chip resistor includes an alumina substrate 101, an upper surface electrode layer 102 and an end face electrode 103 respectively formed of a silver system thick film electrode, a resistor layer 104 formed of a thick film resistor, and a first glass layer 105, a marking glass layer 106 and a second glass layer 107 which respectively serve as protective layers to cover the resistor 104 and are respectively formed of borosilicate lead system glass. Here, the marking glass layer 106 is provided in order that information inherent in a product such as the model number, resistance value, manufacturing number thereof and the like can be marked on it. Also, a Ni plating layer 108 and a Sn-Pb plating layer 109 are applied onto the exposed electrode surfaces by electrolytic plating in order to improve the soldering properties of the exposed electrode surfaces.

In the conventional square chip resistor, the higher the glass layers are located, the smaller coefficients of thermal expansion they have, in order to prevent generation of any crack on the glass surfaces by stresses produced due to differences between the thermal expansion coefficients of the glass layers 105, 106, 107 and that of the alumina substrate 101.

In the above-mentioned Kokai Hei-3-212901, there are used a first glass layer having a softening point of 550 to 570 degrees and a thermal expansion coefficient of $69\times10^{-7}$°/C. to $75\times10^{-7}$°/C., a marking glass having a softening point of 550 to 570 degrees and a thermal expansion coefficient of $68\times10^{-7}$°/C. to $74\times10^{-7}$°/C., and a second glass layer having a softening point of 580 to 630 degrees and a thermal expansion coefficient of $62\times10^{-7}$°/C. to $68\times10^{-7}$°/C.

To form the above-mentioned multi-glass-layer structure, a glass paste is printed and applied and is then dried, after then these operations are repeated, and finally the glass layers are fired, or the printing and firing treatments of the glass pastes are repeated.

However, it has not been easy to obtain such glass as satisfies the above-mentioned softening point and thermal expansion coefficient by adjusting the component ratio of the borosilicate lead glass.

Also, although the protective glass layers of the conventional square chip resistor prevent generation of any crack as mentioned above, in fact, if the stress due to neat exceeds a limit, then a crack can be generated and widened.

SUMMARY OF THE INVENTION

It is an object of the invention to provide a square chip resistor which can control the thermal expansion coefficient of glass easily, uses a plurality of glass layers disposed in such a manner that the higher they are located, the smaller thermal expansion coefficient they have, and can reduce the possibility that there can be generated a crack on the glass surface due to differences between the thermal expansion coefficients of the glass layers and an alumina substrate.

In the square chip resistor according to the invention, when firing the protective glass layers, the glass paste is mixed with inorganic material powder having a smaller thermal expansion coefficient than the glass. Amount of the inorganic material powder is adjusted to thereby adjust the thermal expansion coefficients of the protective glass layers. The inorganic material powder to be mixed is called a filler and, as the filler, alumina ($Al_2O_3$) and the like can be used. The thermal expansion coefficient of alumina is about $72\times10^{-7}$°/C., by adding the alumina, the thermal expansion coefficient of glass can be greatened.

Further, in the square chip resistor of the invention, the protective glass layers have a three-layer structure and the thermal expansion coefficients thereof are changed sequentially to thereby disperse thermal stresses.

According to the square chip resistor of the invention, by mixing a filler into the lower glass layer to greaten the thermal expansion coefficient thereof, a compression stress is applied to the higher glass layers to thereby be able to prevent generation of any crack on the glass surface.

Further, even if any crack is generated, the filler mixed into the glass can prevent the crack from widening over the whole protective glass. Also, because the glass strength is increased by the filler, it is also possible to reduce the thicknesses of the protective glass layers.

DETAILED DESCRIPTION OF THE PREFERRED EMBODIMENT

Figure 1:
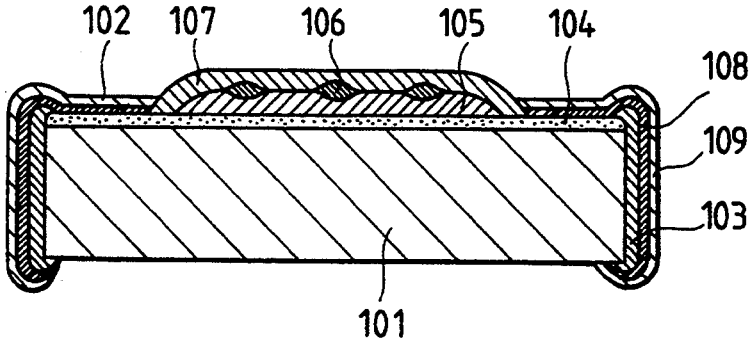
FIG. 1 PRIOR ART
FIG. 1 is a section view of the structure of a conventional square chip resistor.
Figure 2:
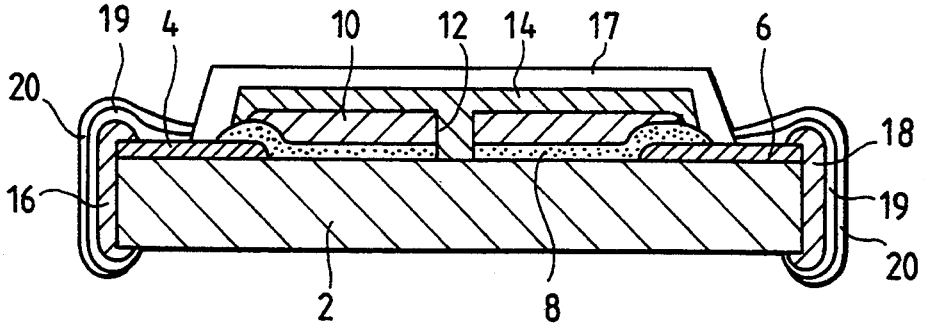
FIG. 2 is a section view of the structure of a square chip resistor according to the invention; and, FIG. 3 is an explanatory view of a method of manufacturing the square chip resistor according to the invention.

FIG. 2 shows an embodiment of a square chip resistor according to the invention. In this embodiment, there is provided a rectangular substrate 2 which is formed of an insulating material such as alumina or the like. Between the opposed edge portions of the surface of the substrate 2, there are disposed a pair of primary electrodes 4, 6 at a given distance. Between the primary electrodes 4, 6 on the substrate 2, there is provided a resistor 8 which is formed by means of a printing and firing treatment in such a manner that it stretches over the respective primary electrodes 4, 6. On the surface of the resistor 8, there is formed a first glass layer 10 which covers the whole surface of the resistor 8. In particular, the first glass layer 10 covers the whole surface of the resistor 8 and part of the primary electrodes 4, 6. Reference numeral 12 designates a notch which is formed on the resistor 8 from above the first glass layer 10 by means of a laser trimming treatment. Also, on the upper surface of the first glass layer 10, there is formed a second glass layer 14 which is used to prevent plating adhesion when the resistor layer 8 is out of printing. Further, on the upper surface of the second glass layer 14, there is formed a third glass layer 17 by a printing and firing treatment which serves as a protective layer to cover the second glass layer 14 and resistor 8 wholly. The second glass layer 14 is embedded into the notch 12 and the surface of the resistor 8 on the wall surface of the notch 12 is protected by the second glass layer 14.

And, on the end face portions of the substrate 2, there are formed secondary electrodes 16, 18 which are electrically connected to the primary electrodes 4, 6, respectively. In the secondary electrodes 16, 18 there are formed a nickel plate layer 19 and a soldering plate layer 20.

The primary electrodes 4, 6 are formed so as to have a thickness of 10 μm or less, and the thicknesses of the nickel plate layer 19 and soldering plate layer 20 are respectively 3 μm or less. Also, the thickness of the second glass layer is 20 μm or less, and the total thickness of the first glass layer 10, second glass layer 14 and third glass layer 17 is 30 μm or less.

Figure 3A:
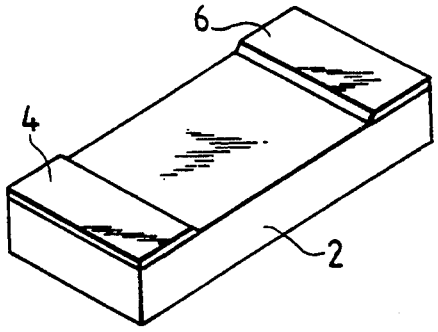

Describing briefly a method of manufacturing the present chip resistor with reference to FIG. 3, as shown in FIG. 3A, the rectangular substrate 2 is formed of an insulating material such as alumina or the like and a pair of primary electrodes 4, 6 are formed on the opposed edge portions of the substrate 2, respectively.

Figure 3B:
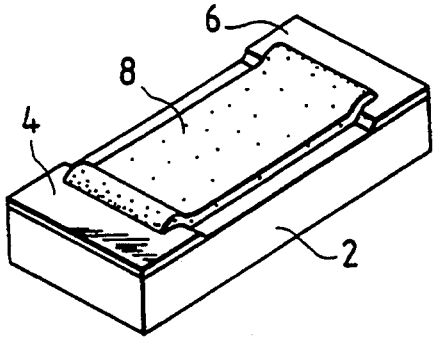

Next, as shown in FIG. 3B, on the surface of the substrate 2 between the primary electrodes 4 and 6, a resistor 8 is formed by firing so as to cover part of the surfaces of the primary electrodes 4, 6. The resistor 8 is electrically connected to the primary electrodes 4 and 6.

Figure 3C:
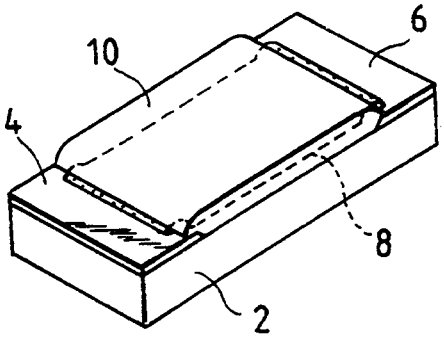

After then, as shown in FIG. 3C, a first glass layer 10, of which a thermal expansion coefficient is adjusted in a range of $66\times10^{-7}$°/C. to $76\times10^{-7}$°/C., is formed to cover the resistor 8 by a printing and firing treatment. The first glass layer 10 is colored in semi-transparent green in order to improve laser absorption.

Figure 3D:
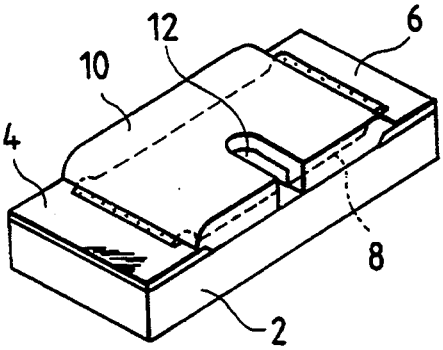

Next, as shown in FIG. 3D, a laser trimming treatment is applied onto the resistor 8 from above the first glass layer 10, and the resistance value of the resistor 8 is adjusted to a given value. A notch 12 formed in the resistor 8 and first glass layer 10 shows a trace of the laser trimming.

After then, a second glass layer of colorless, transparent glass, of which a thermal expansion coefficient is adjusted in a range of $63\times10^{-7}$°/C. to $73\times10^{-7}$°/C., is formed on the first glass layer, and further a third glass layer of black glass is printed and fired on the second glass layer. A thermal expansion coefficient of the third glass layer is adjusted in a range of $60\times10^{-7}$°/C. to $70\times10^{-7}$°/C. Alumina powder is mixed into the third black glass layer to thereby adjust the thermal expansion coefficient of the glass to a range of $60\times10^{-7}$°C. to $70\times10^{-7}$°/C. smaller than those of the first an second glass layers. The thermal expansion coefficient of alumina is about $72\times10^{-7}$°/C. and, in general, it is larger than the thermal expansion coefficient of glass. On the third black glass layer, marking characters such as a model number, a resistance value and the like are marked in white or yellow glass. Because the background color is black, the marking characters can be recognized very clearly.

Mixing of the filler into the glass can be achieved by mixing the filler into the glass paste before firing.

Also, if the thermal expansion coefficient of the second glass layer is set at a value between the thermal expansion coefficients of the first and third glass layers, then it is possible to disperse the stress that is produced in the glass layer.

As has been described heretofore, according to the square chip resistor of the invention, due to the fact that the powder of inorganic material such as alumina or the like having a greater thermal expansion coefficient than the glass is mixed into the glass paste when the protective layer is fired to thereby adjust the thermal expansion coefficient of the protective glass layer, a compression stress can be applied to the higher protective glass layers to thereby prevent generation of cracks on the glass surfaces.

Further, in the square chip resistor of the invention, the protective glass layer has a three-layer structure and thus, if the thermal expansion coefficients thereof are changed sequentially, then a thermal stress can be dispersed.

In addition, according to the square chip resistor of the invention, even if any crack is produced, the crack is prevented from spreading over the whole protective glass surface because the filler is mixed into the glass. Also, since the glass strength is increased by the filler, the thickness of the protective glass layer can be reduced.

What is claimed is:

1. A square chip resistor comprising:

a substrate formed of an insulating substrate;

a pair of primary electrodes formed opposedly on said substrate;

a resistor formed on said substrate so as to stretch over said pair of primary electrodes;

a first glass layer formed so as to cover the surface of said resistor and having a thermal expansion coefficient of $66\times10^{-7}$°/C. to $76\times10^{-7}$°/C.;

a second glass layer formed on said first glass layer and having a thermal expansion coefficient of $63\times10^{-7}$°/C. to $73\times10^{-7}$°/C.;

a third glass layer formed on said second glass layer and having a thermal expansion coefficient of $60\times10^{-7}$°/C. to $70\times10^{-7}$°/C.; and, a pair of secondary electrodes electrically connected to said pair of primary electrodes respectively and formed on the edge portions of said substrate respectively, wherein a powder of an inorganic material having a greater thermal expansion coefficient than glass is added to said glass layers.

2. A square chip resistor as set forth in claim 1, wherein said third glass layer is formed of black glass and characters representing a rating and the like are printed on said third glass layer by means of white or yellow glass.

3. A square chip resistor as set forth in claim 1, wherein said inorganic material powder is alumina.

* * * * *

UNITED STATES PATENT AND TRADEMARK OFFICE

CERTIFICATE OF CORRECTION

PATENT NO. : 5,379,017

DATED : January 3, 1995

INVENTOR(S) : Takafumi Katsuno

It is certified that error appears in the above-indentified patent and that said Letters Patent is hereby corrected as shown below:

Column 1, line 48, "°/C." (both occurrences) should read --/°C.--;

Column 1, line 50, "°/C." should read --/°C.--;

Column 1, line 51, "°/C." should read --/°C.--;

Column 1, line 53, "°/C." (both occurrences) should read --/°C.--;

Column 1, penultimate line, "neat" should read --heat--;

Column 2, line 21, "°/C." should read --/°C.--;

Column 3, line 39, "°/C." (both occurrences) should read --/°C.--;

Column 3, line 51, "°/C." (both occurrences) should read --/°C.--;

Column 3, lines 55 and 56, "°/C." should read --/°C.--;

Column 3, line 58, "°/C." should read --/°C.--;

Column 3, line 59, "°/C." should read --/°C.--;

Column 3, line 61, "°/C." should read --/°C.--;

Column 4, line 43, "°/C." (both occurrences) should read --/°C.--;

UNITED STATES PATENT AND TRADEMARK OFFICE

CERTIFICATE OF CORRECTION

PATENT NO. : 5,379,017

DATED : January 3, 1995

INVENTOR(S) : Takafumi Katsuno

It is certified that error appears in the above-indentified patent and that said Letters Patent is hereby corrected as shown below:

Column 4, line 46, "°/C." (both occurrences) should read --/°C.--;

Column 4, line 49, "°/C." (both occurrences) should read --/°C.--.

Signed and Sealed this

Second Day of May, 1995

Bruce Lehman

*Attest:*

BRUCE LEHMAN

*Attesting Officer*

*Commissioner of Patents and Trademarks*